US006059902A

United States Patent [19]

Yoshihara et al.

[11] Patent Number: 6,059,902

[45] Date of Patent: May 9, 2000

[54] ALUMINUM ALLOY OF EXCELLENT MACHINABILITY AND MANUFACTURING METHOD THEREOF

[75] Inventors: Shinji Yoshihara; Masakazu Hirano, both of Shimonoseki, Japan

[73] Assignee: Kabushiki Kaisha Kobe Seiko Sho, Kobe, Japan

[21] Appl. No.: 08/880,689

[22] Filed: Jun. 23, 1997

[30] Foreign Application Priority Data

Jun. 26, 1996 [JP] Japan ..... 8-186578

[51] Int. Cl.[7] ..... C22C 21/02

[52] U.S. Cl. ..... 148/550; 148/417; 148/439; 148/440; 420/534; 420/546

[58] Field of Search ..... 148/417, 439, 148/440, 550; 420/534, 546

[56] References Cited

U.S. PATENT DOCUMENTS

| | | | |
|---|---|---|---|
| 3,841,919 | 10/1974 | Hasegawa et al. | 148/440 |
| 5,223,050 | 6/1993 | Bryant et al. | 148/440 |
| 5,523,050 | 6/1996 | Lloyd et al. | 148/440 |

FOREIGN PATENT DOCUMENTS

| | | |
|---|---|---|
| 0 141 501 | 8/1984 | European Pat. Off. . |
| 1 483 229 | 9/1965 | Germany . |
| 665 223 A5 | 2/1985 | Switzerland . |
| 384 889 | 4/1932 | United Kingdom . |

*Primary Examiner*—George Wyszomierski
*Attorney, Agent, or Firm*—Oblon, Spivak, McClelland, Maier & Neustadt, P.C.

[57] ABSTRACT

An aluminum alloy containing Si: 1.5–12% (mass % here and hereinafter), Mg: 0.5–6% and, optionally, at least one of Mn: 0.5–2%, Cu: 0.15–3% and Cr: 0.04–0.35% and, further, containing Ti: 0.01–0.1% and the balance of Al and inevitable impurities, in which the average grain size of crystallized grains of Si system compounds is from 2 to 20 $\mu$m and an area ratio thereof is from 2 to 12%. The alloy is melted to obtain a cast ingot having DAS (Dendrite Arm Spacing) of 10 to 50 $\mu$m, which is then put to a soaking treatment at 450 to 520° C. and then to extrusion molding. The aluminum alloy has excellent machinability with no addition of low melting metals.

11 Claims, No Drawings

ALUMINUM ALLOY OF EXCELLENT MACHINABILITY AND MANUFACTURING METHOD THEREOF

BACKGROUND OF THE INVENTION

1. Field of the Invention

The present invention concerns an aluminum alloy of excellent machinability suitable, for example, to machine parts which often undergo machining fabrications in the course of manufacture.

2. Description of Related Art

Among aluminum alloys, not heat treated alloys including 3000 series Al—Mn alloys have medium mechanical performances, are excellent in corrosion resistance and cold forgeability and can be formed at a low cost. They have generally been used, for example, as machine parts, in which they undergo machining or drilling fabrication after cold forging into final products. However, it is difficult to use the alloys of this series to machine parts requiring complicated machining or drilling since chips formed during machining are difficult to remove and deteriorate machinability.

Further, among aluminum alloys, not heat treated alloys including 5000 series Al—Mg alloys have medium mechanical performance (somewhat higher strength level than 3000 series), are excellent in corrosion resistance and cold workability and can be fabricated at a reduced cost. They have generally been used, for example, to manufacture optical instruments such as cylindrical members of cameras and microscopes and other machine parts, in which they generally undergo machining or drilling fabrication after cold forging into final products. However, it is difficult to use the alloys of this series to machine parts requiring complicated machining or drilling fabrication since chips formed during machining are difficult to remove and deteriorate machinability.

On the other hand, existent aluminum alloys of high machinability contain low melting metals such as Pb, Bi and Sn as effective addition elements as typically represented by AA6262 alloy (Si: 0.4–0.8 mass %, Mg: 0.8–1.2 mass %, Cu: 0.15–0.4 mass %, Pb: 0.4–0.7 mass %, Bi: 0.4–0.7 mass % and the balance of Al) in the field of ductile material (refer to Japanese Patent Laid-Open Sho 54-143714, Japanese Patent Laid-Open Hei 3-39442). Such low melting metals are barely solid-solubilized in aluminum and cause granular micro segregation in the aluminum alloy. The low melting metal grains are melted by the heat of fabrication generated upon machining fabrication and act to remove the chips and improve the machinability of the aluminum alloys.

The AA6262 alloys are heat treated type aluminum alloys employed as the raw material for machine parts which undergo machining fabrication, particularly, drilling in the course of manufacture. For example, they are used as a material for the housing of an anti-skid brake system of an automobile. It is expected that the effect of improving the machinability by the addition of the low melting metals such as Pb, Bi and Sn can be obtained not only in the heat treated alloys but also in the not heated treated alloys (refer to Japanese Patent Laid-Open Hei 3-39442 described above).

However, although the addition of the low melting metals to the aluminum alloys can improve the machinability this lowers the corrosion resistance and causes hot shortness by the low melting metals and it is necessary to employ sufficient care in working the alloys. Further, only alloys containing Pb and Bi can be recycled as scrap, as a result their recycling performance is poor. Thus, their usefulness is limited.

Further, the machine parts are sometimes anodized at the surface to improve corrosion resistance, wear resistance or decorative effect. However, with Pb and Bi-added aluminum alloys, oxide films are not formed on regions of the surface at which Pb and Bi are exposed and this results in inhomogeneous and non-glossy anodic oxidation films.

Although not heat treated aluminum alloys not containing low melting metals and having improved machinability were proposed in Japanese Patent Laid-Open Sho 60-184658, the machinability was not sufficient as compared with the aluminum alloys containing low melting metals such as Pb, Bi and Sn.

SUMMARY OF THE INVENTION

The present invention has overcome these problems in the prior art and it is an object having the invention to provide an aluminum alloy of excellent machinability, and also provide an aluminum alloy of excellent corrosion resistance, good recycling performance and capable of forming homogeneous anodic oxidation films. The present inventors have studied the foregoing problems and, as a result, have descovered that the machinability can be improved without adding low melting metals such as Pb, Bi and Sn but, instead, by dispersing a second phase hard grains of an appropriate grain size in a mother phase at a predetermined area ratio.

The foregoing object of the present invention can be attained by an aluminum alloy of excellent machinability in which an average grain size of second phase hard grains is from 2 to 20 $\mu$m and an area ratio of them is from 2 to 12%. The second phase hard grains preferably comprise Si system compounds crystallized upon coagulation of a molten aluminum alloy.

When the second phase hard grains are the Si system compound, a preferred composition of the aluminum alloy contains Si: 1.5–12% and Mg: 0.5–6%. More specifically, there can be mentioned an aluminum alloy containing Si: 1.5–12%, Mg: 0.5–6% and the balance of Al and inevitable impurities, and an aluminum alloy containing at least one of Mn: 0.5–2%, Cu: 0.15–3%, Cr: 0.04 to 0.35% and an aluminum alloy further containing Ti: 0.01–0.1% in addition to the ingredients described above.

The second phase hard grains of a predetermined average grain size and an area ratio can be obtained by using the aluminum alloys described above, by casting the aluminum alloy described above to obtain a cast ingot with a DAS (Dendrite Arm Spacing) of from 10 to 50 $\mu$m, subjecting the same to soaking treatment at 450–520° C. and then to extrusion molding.

DETAILED DESCRIPTION OF PREFERRED EMBODIMENTS

In the aluminum alloy according to the present invention, second hard grains with an average grain size from 2 to 20 $\mu$m and having an area ratio thereof from 2 to 12% are dispersed in a mother phase, whereby the hard grains stop the slippage of crystals caused in chips during machining, which slipping lines are accumulated to form minute cavities, and such cavities constitute origins for inducing the removal of the chips, to show excellent machinability.

The second phase hard grains are preferably those having hardness at least greater than the aluminum alloy matrix and with less matching property at the boundary with the matrix and they can include crystallized or precipitated grains of Si and Si system compounds, as well as Ni system compound and Fe system compounds and, among them, Si and Si system compounds are most preferred in view of the hardness and the matching property.

The average grain size of the second phase hard grains is defined as 2 to 20 μm since accumulation of slipping lines occurs less likely if the average grain size is smaller than 2 μm, to reduce portions as the origins for inducing the removal of chips which deteriorates the machinability. On other hand, if the average grain size exceeds 20 μm, the extrudability is worsened, violent tool wearing occurs upon machining and the elongation of the material is deteriorated. Further, the area ratio of the second phase hard grains is defined as from 2 to 12%, because if the area ratio is less than 2%, a smaller number of portions are formed as the origins for inducing chip removal. On the other hand, if the area ratio exceeds 12%, extrudability is worsened and violent tool wearing is likely during machining, and elongation of the material is deteriorated. The average grain size of the second phase hard grains is preferably from 3 to 10 μm, more preferably, 4 to 6 μm, while the area ratio is preferably from 5 to 10% and, further preferably, from 5 to 7%.

Then, reasons for adding each of the elements and reasons for defining the addition amount in the aluminum alloy described above will be explained.

Si: 1.5–12.0%

Si forms Si system compounds in an aluminum structure to improve the disconnection of chips and improve the machinability. This is because the Si system compounds constitute origins for inducing removal of the chips. It is necessary that the lower limit value for the addition of Si exceeds 1.5% which is a solid-solubilization limit in aluminum. For obtaining a distinct effect of Si, addition by more than 2.0% is desirable. That is, with a view point of obtaining excellent machinability, Si is preferably from 2.0 to 12.0%. On the other hand, it is necessary that the upper limit for the addition of Si is less than 12.0% which is an eutectic point so as not to lower the extrudability or cause embrittlement of the extrusion material due to the occurrence of coarse primary Si that increases the deformation resistance. It is particularly preferred that the Si contest be less than 6% for satisfactory extrusion moldability.

Mg: 0.5–6.0%

Mg has an effect of improving chips removal improving the strain hardenability and enhancing the strength of the raw material by solid solubilization. If the Mg content is less than 0.5%, no sufficient effect can be obtained. On the contrary, if it is added in excess of 6.0%, the deformation resistance is increased to lower the extrudability. With a view point of ensuring the strength and the preferred extrudability, the addition amount is preferably about from 1.0% to 3.0%. With a view point of improving the extrudability while suppressing the deformation resistance during extrusion, a remarkable effect can be obtained by setting the content to less than 1.0%, particularly, to less than 0.9%. Accordingly, Mg may be 0.5 to 1.0% or 0.5 to 0.9% in this case.

Mn: 0.5–2.0%

Mn has an effect of improving the strength of the raw material by solid solubilization and has an effect of promoting chip removal for improving the strain hardenability. If the Mn content is less than 0.5%, no sufficient effect can be obtained. On the other hand, if Mn is added in excess of 2.0%, the extrudability is lowered. Particularly, with a view point of ensuring the strength and the satisfactory extrudability, the addition amount is desirably more than 0.7% and less than 1.5%.

Cu: 0.15–3.0%

Cu has effects of improving the strength of the raw material by solid solubilization and also promoting chip removal for improving the strain hardenability and is added instead of or together with Mn. However, if the Cu content is less than 0.15%, the effect is poor. On the other hand, if it is added in excess of 3.0%, the corrosion resistance is lowered and the extrudability is lowered as well. Particularly, with a view point of ensuring the strength, satisfactory corrosion resistance and extrudability, the addition amount is desirably from 0.3% to 0.8%.

Cr: 0.04–0.35%

Cr forms a compound with Al and constitutes origins for inducing removal of chips to improve the machinability. If the addition amount is less than 0.04%, the effect is not sufficient. On the other hand, if it exceeds 0.35%, coarse compounds are formed to lower the extrudability.

Ti: 0.01–0.1%

Ti refines the cast structure and stabilizes the mechanical property. If the Ti content is less than 0.01%, no effect can be obtained. On the other hand, even if it is added in excess of 0.1%, the effect is saturated.

Further, as the inevitable impurities in the aluminum alloy, Pb, Bi and Sn are allowable each in an amount of less than 0.05 mass % in accordance with chemical ingredients specified in JIS H 4040. Such low melting metals, if contained in a great amount, may deteriorate the corrosion resistance of the aluminum alloy, but gives no undesired effect on the characteristics if the content is within the range described above. Further, other inevitable impurities are also allowable each in an amount of less than 0.05 mass %.

In order to obtain a distribution of the second phase hard grains in the Al—Si—Mg alloys described above, it is necessary to obtain a cast ingot with DAS of less than 50 μm, which is then put to soaking treatment at 450 to 520° C. The cast ingot is used as the material for machining fabrication after extrusion, and in accordance with the composition or in accordance with the necessity, it can be used for machining fabrication after subjecting to hardening-aging treatment, or solid solubilization by reheating-hardening-aging treatment, or subjecting to machining fabrication after forging.

Further, DAS is controlled by a solification rate in the casting step. If it is more than 50 μm, the average grain size of the Si system compound after the soaking treatment is more than 20 μm. On the other hand, if DAS is less than 10 μm, it is difficult to obtain an average grain size of more than 2 μm. If the temperature of the soaking treatment is higher than 520° C., the grains grow to greater than 20 μm of the average grain size. On the contrary, if the temperature is lower than 450° C., the deformation resistance is large and the extrudability is degraded. The time for the soaking treatment is about 1 to 24 hr. If it is shorter than 1 hr, there is no effect, whereas the effect is saturated even if it is longer than 24 hr.

EXAMPLE

Examples of the present invention will be explained more specifically in comparison with comparative examples.

Alloys of chemical compositions as shown in Table 1 were melted, and extrusion billets each of 160 mm diameter were manufactured under various cooling conditions by a semi-continuous casting, each of which was subjected to soaking treatment at a soaking temperature shown in Table 1 for 12 hours. After measuring DAS of the extruded billet respectively, they were extruded into 60 mm diameter at an extrusion temperature of 500° C., cooled directly with water, then applied with an aging treatment for 170° C.×6 hr to prepare test materials. The average grain size and the area ratio of each Si compound system grains, the machinability, tool wearing and mechanical properties were measured by the following procedures. For Comparative Example 11, since extrusion was not possible measurement was not conducted.

Average grain size, area ratio; The average grain size and the area ratio of the Si system compound grains were determined based on an optical microscopic photograph at 400× by using an image analyzing apparatus (LOOZEX, trade name of products manufactured by Nireco Co.)

Machinability: Machining was conducted by using a commercially available drill of 10 mm diameter made of high speed steels, under the conditions at a number of rotation of 1500 mm/min and a feed rate of 300 m/min. The weight per 100 chips was measured and evaluation was made as "o" for those having less than 0.5 g weight and as "×" for those exceeding 0.5 g weight.

Tool wearing: 50 holes each having 20 mm depth were formed to a test material of 30 mm thickness under the same conditions as described above and evaluation was made as "o" for those having $R_{mazx}$ at the inner surface of the 50th hole of less than 6.3 $\mu$m and as "x" for those having $R_{max}$ in excess of 6.3 $\mu$m.

Mechanical properties; JIS No. 4 test specimens sampled in the direction of extrusion were used and tensile strength ($\sigma_B$), yield point ($\sigma_{0.2}$) and elongation ($\sigma$) were measured in accordance with the metal material test method as defined in JIS Z 2241.

and are poor in the elongation of the material. Comparative Example 8 with less DAS, although capable of satisfying the definition of the present invention for the composition, has small average grain size of the second phase hard grains and is poor in the machinability. Comparative Example 9 with large DAS has a large average grain size with remarkable tool wearing and is poor in the elongation of the material. Comparative Example 10 subjected to soaking at a high temperature has a large average grain size with remarkable tool wearing and is poor in the elongation.

As has been described above, the aluminum alloy according to the present invention is excellent in the machinability and also excellent in the mechanical properties although low melting metals such as Pb and Bi are not used. In addition, since it does not cause troubles such as twining of long chips around the tool and shows less tool wearing, it is particularly suitable as a material for machine parts prepared by automatic operations using an automatic machine tool and, in addition, it does not result in hot shortness caused by low melting metals, has no drawback in recycling and is of an extremely great industrial value.

Further, since the aluminum alloy according to the present invention improves the machinability with no addition of Pb or Bi, it is excellent in anodic oxidation processability and capable of forming homogeneous and lustrous anodic oxidation films.

TABLE 1

| | Chemical ingredient (wt %) | | | | | | DAS | Soaking temperature | Average grain size | Area ratio | Machin- | Tool wearing | $\sigma_8$ | $\sigma_{0.2}$ | $\delta$ |
|---|---|---|---|---|---|---|---|---|---|---|---|---|---|---|---|
| | Si | Mg | Cu | Mn | Cr | Ti | $\mu$m | ° C. | $\mu$m | % | ability | Example | kg/mm$^2$ | kg/mm$^2$ | % |
| Examples | | | | | | | | | | | | | | | |
| 1 | 2.0 | 0.5 | 0.5 | 1.0 | — | 0.03 | 30 | 470 | 5 | 6 | ○ | ○ | 36 | 31 | 17 |
| 2 | " | " | — | — | — | " | 30 | " | 10 | 8 | ○ | ○ | 35 | 30 | 14 |
| 3 | " | " | — | — | 0.2 | " | 30 | " | 15 | 10 | ○ | ○ | 34 | 29 | 13 |
| 4 | 8.0 | " | — | — | — | " | 25 | " | 10 | 11 | ○ | ○ | 37 | 33 | 14 |
| Comparative Examples | | | | | | | | | | | | | | | |
| 5 | 1.0 | " | 0.5 | — | — | " | 30 | " | 1 | 5 | x | ○ | 35 | 30 | 15 |
| 6 | 14 | " | " | — | — | " | 30 | " | 25 | 11 | ○ | x | 35 | 29 | 6 |
| 7 | 16 | 1.0 | " | — | — | " | 25 | " | 30 | 15 | ○ | x | 35 | 27 | 4 |
| 8 | 2.0 | 0.5 | " | 1.0 | — | " | 5 | " | 1 | 4 | x | ○ | 34 | 28 | 16 |
| 9 | " | " | " | " | — | " | 60 | " | 30 | 8 | ○ | x | 35 | 29 | 5 |
| 10 | " | " | " | " | — | " | 30 | 550 | 27 | 7 | ○ | x | 33 | 28 | 6 |
| 11 | " | " | " | " | — | " | 30 | 400 | — | — | — | — | — | — | — |

*Extrusion was impossible for Comparative Example 11

The results of the test are collectively shown in Table 1. Test Nos. 1–4 are for those capable of satisfying the definitions of the present invention both for the composition and the manufacturing conditions, Test Nos. 5–7 are for those capable of satisfying the definition of the present invention only for the manufacturing conditions, and Test Nos. 8–11 are for those capable of satisfying the definition of the present invention only for the composition.

As shown in Table 1, Examples 1–4 of the invention in which the composition and the average grain size and the area ratio of the second phase hard grains (Si system compound) can satisfy the definition of the present invention are excellent in the machinability with less tool wearing. On the other hand, Comparative Example 5 with less Si amount has a small average grain size and is poor in the machinability. Comparative Examples 6 and 7 with much Si amount have large average grain size, cause remarkable tool wearing

What is claimed is:

1. A method of manufacturing an aluminum alloy, which comprises casting an aluminum alloy containing Si: 1.5 to less than 6% and Mg: 0.5–6% to obtain a cast ingot having DAS (Dendrite Arm Spacing) of from 10 to 50 $\mu$m, subjecting said ingot to a soaking treatment at 450–520° C. and then to extrusion molding, wherein second-phase grains in said alloy comprise Si and/or Si system compounds, said second phase grains are crystallized from a melt of said alloy, and said second phase grains have an average grain size of 2 to 20 $\mu$m and an area ratio of 2 to 12%.

2. An aluminum alloy, comprising:

1.5-to less than 6 mass % Si, 0.1–6 mass % Mg, and

Al, wherein second-phase grains in said alloy comprise Si and/or Si system compounds, said second phase grains are crystallized from a melt of said alloy, and said second phase grains have an average grain size of 2 to 20 $\mu$m and an area ratio of 2 to 12%.

3. The aluminum alloy of claim 2, further comprising at least one member selected from the group consisting of 0.5–2 mass % Mn, 0.15–3 mass % Cu and 0.04–0.35 mass % Cr.

4. The aluminum alloy of claim 3, further comprising 0.01–0.1 mass % Ti.

5. The aluminum alloy of claim 2, further comprising 0.01–0.1 mass % Ti.

6. The aluminum alloy of claim 2, wherein said second phase grains have an average grain size of 4–20 $\mu$m.

7. The aluminum alloy of claim 2, consisting essentially of said Si, said Mg, said Al and inevitable impurities.

8. The aluminum alloy of claim 7, wherein said inevitable impurities comprise less than 0.05 mass % Pb, less than 0.05 mass % Bi, and less than 0.05 mass % Sn.

9. The aluminum alloy of claim 7, further consisting essentially of at least one member selected from the group consisting of 0.5–2 mass % Mn, 0.15–3 mass % Cu and 0.04–0.35 mass % Cr.

10. The aluminum alloy of claim 7, further consisting essentially of 0.01–0.1 mass % Ti.

11. The aluminum alloy of claim 7, wherein said second phase grains have an average grain size of 4–20 $\mu$m.

* * * * *